United States Patent [19]

Graff

[11] B 3,990,800

[45] Nov. 9, 1976

[54] LINE MARKER ON ICE

[76] Inventor: Robert Graff, 23 Lenox Place, Freeport, N.Y. 11520

[22] Filed: Mar. 12, 1975

[21] Appl. No.: 557,621

[44] Published under the second Trial Voluntary Protest Program on February 3, 1976 as document No. B 557,621.

[52] U.S. Cl. ..... 401/219; 401/48

[51] Int. Cl. ..... B43m 11/02

[58] Field of Search ..... 401/208, 218, 219, 137, 401/138, 140, 48, 197, 203, 204, 188; 56/249; 222/176, 177

[56] References Cited

UNITED STATES PATENTS

| | | | |
|---|---|---|---|
| 2,988,763 | 6/1961 | Sweet | 401/219 |
| 3,112,512 | 12/1963 | Arrault | 401/219 |
| 3,179,298 | 4/1965 | Collins | 222/177 |
| 3,207,379 | 9/1965 | Waldrum | 222/177 |
| 3,241,175 | 3/1966 | Johnson | 401/208 X |
| 3,453,058 | 7/1969 | Bixel | 401/219 X |

FOREIGN PATENTS OR APPLICATIONS

| | | | |
|---|---|---|---|
| 675,298 | 10/1929 | France | 15/235 B |

*Primary Examiner*—Lawrence Charles
*Attorney, Agent, or Firm*—Paul W. Garbo

[57] ABSTRACT

An apparatus for applying colored lines on ice, in which a roller can be moved over ice in a positive and controllable manner, is provided with at least one wheel having a multiplicity of small protrusions or points on its peripheral surface. The protrusions on the tread of the wheel dig into the ice to give easy traction and thus ensure proper rotation of the roller without undesired swerving slippage.

7 Claims, 5 Drawing Figures

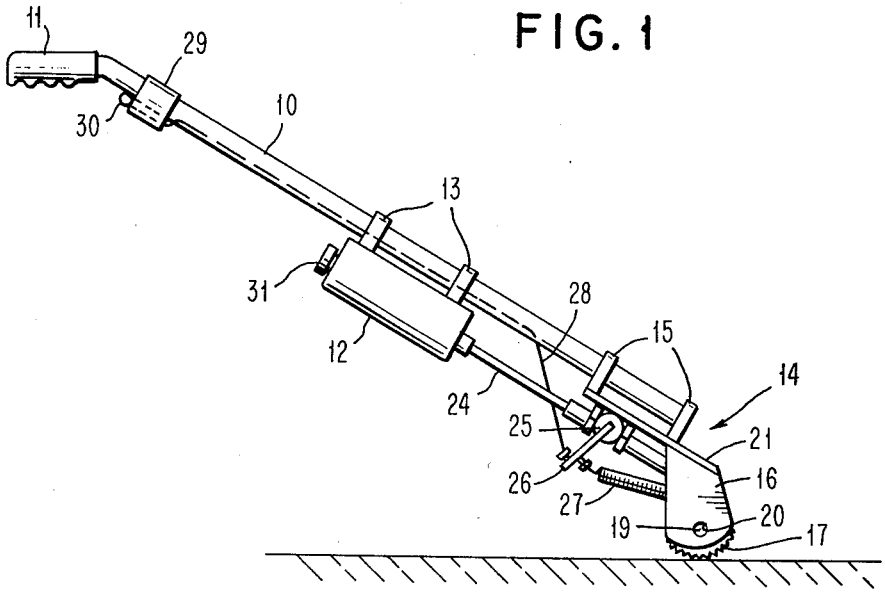
FIG. 1
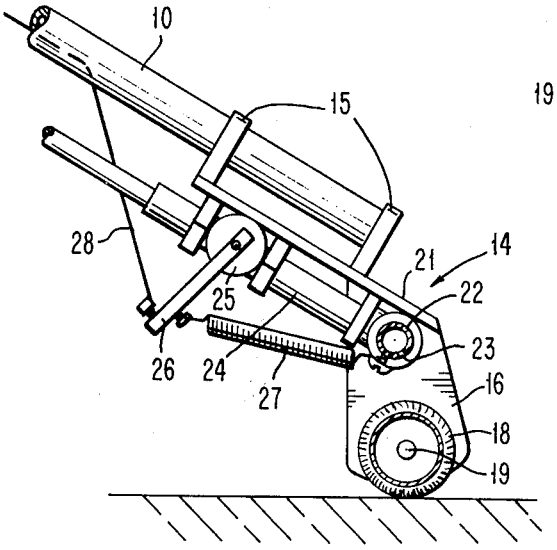
FIG. 2
FIG. 4
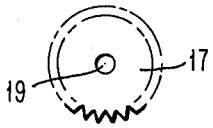
FIG. 5
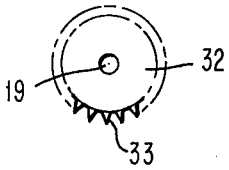
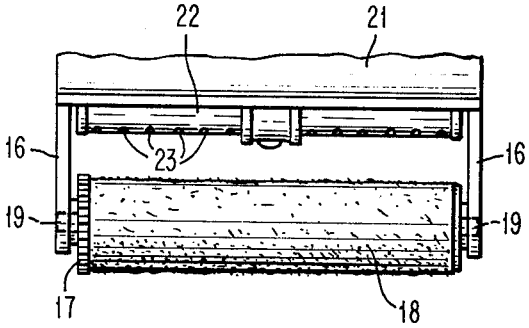
FIG. 3

LINE MARKER ON ICE

BACKGROUND OF THE INVENTION

Ice hockey is a popular sport requiring an ice hockey rink with colored lines marked thereon to designate different zones. Various devices have been improvised to apply the colored lines on the ice but none has been entirely satisfactory. A common shortcoming of the prior devices has been the tendency for such devices while moving over the ice to swerve from the desired line because of uncontrollable slippage. Moreover, the simplest way to apply a colored line on a surface is to use the popular paint roller. However, a roller will not rotate properly on a slippery surface such as ice particularly when the roller is wetted by the colored liquid used to form the colored lines on the ice.

Accordingly, a principal object of this invention is to provide an apparatus for applying colored lines on ice with a roller which will have positive rotation while moving over the ice.

Another object is to provide such an apparatus which can be moved on ice without uncontrollable swerving slippage from a desired linear direction.

These and other objects and advantages of the invention will be apparent from the description which follows.

SUMMARY OF THE INVENTION

In accordance with this invention, an apparatus with a coating roller for applying a colored liquid on ice to form a colored line on the ice is provided with at least one wheel having on its peripheral surface or tread small protrusions or points which are capable of digging into the ice so that the wheel will rotate without slipping when the apparatus is moved on the ice. The skid-proof wheel is associated with or connected to the roller so that rotation of the wheel causes rotation of the roller.

The simplest and preferred way of transmitting the rotation of the skid-proof wheel to the roller is to connect the wheel and roller in axial alignment. However, the wheel with the ice-gripping tread may be arranged in tandem relation to the coating roller and through the use of any desired driving linkage the rotation of the wheel will be transmitted to the roller. Common driving linkages between two rotary elements include meshing gears, chain and sprockets, and belt and pulleys.

The one or more wheels of the apparatus used to ensure positive rotation of the coating roller while moving over ice have on their treads small protrusions which are capable of digging into the ice with the result that the wheels will not slip on the ice. The skid-proof tread of the wheels may comprise small spikes, gear teeth or other pointed projections that will penetrate the surface of the ice and thus prevent skidding of the wheels while rolling over the ice.

The apparatus of the invention is provided with a tank to hold the colored liquid which is to be applied on the ice. A pipe or tubing conveys the liquid from the tank to means for distributing the liquid on the coating roller. Desirably, the pipe or tubing is provided with valve means to adjust and control the flow of liquid from the tank to the coating roller.

BRIEF DESCRIPTION OF THE DRAWINGS

The further description of the invention will refer to the appended drawings of which:

FIG. 1 is a side elevation of a preferred embodiment of the invention;

FIG. 2 is an enlarged section view of the lower end of FIG. 1, the section being taken normal to the axis of the coating roller;

FIG. 3 is a front view of the coating roller shown in FIG. 2 together with closely associated structural elements;

FIG. 4 is an enlarged side view of the wheel with gear teeth on its peripheral surface shown in FIG. 1; and FIG. 5 is a side view of an alternative skid-proof wheel having small spikes on its tread.

DESCRIPTION OF PREFERRED EMBODIMENTS:

The apparatus of FIGS. 1, 2 and 3 for applying colored lines on ice comprises tubular handle 10 with rubber hand grip 11 on its upper end, liquid tank 12 with two clamps 13 fastened to the middle portion of handle 10, and coating roller mechanism 14 attached to the lower end of handle 10 by two clamps 15.

Coating roller mechanism 14 comprises two spaced side plates 16 between which are disposed gear wheel 17 and coating roller 18 connected to one another in axial alignment. Shaft 19 of the axial combination is supported at its opposite ends in a bearing bore 20 in each of the two spaced side plates 16. While the apparatus shown in FIGS. 1 and 2 has a single gear wheel 17, it can easily be made with two wheels 17, one wheel 17 being placed at each axial end of roller 18.

The two spaced side plates 16 are fastened to plate 21 by screws or welding and plate 21 is in turn attached to clamps 15 which hold the entire coating roller mechanism 14 on the lower end of tubular handle 10. Liquid distributing header 22 is fastened to the bottom of plate 21 so that the series of perforations 23 will discharge the desired colored liquid onto coating roller 18. Header 22 is connected by pipe 24 to tank 12.

The flow of liquid from tank 12 to header 22 is controlled by valve 25 in pipe 24. The stem of valve 25 has lever arm 26 attached thereto. Tension spring 27 is connected to the outer end of lever arm 26 and to header 22. The tension of spring 27 keeps valve 25 closed so that liquid cannot flow to header 22. Steel wire 28 fastened to the outer end of lever arm 26 passes through a hole into and up tubular handle 10 until it again emerges through a hole in handle 10 near hand grip 11. The upper end of wire 28 is loosely held in collar 29 on handle 10 and terminates in gripping ring or knob 30. A pull on ring 30 causes lever arm 26 to turn clockwise and thus open valve 25 permitting liquid to flow to header 22. When a pull is no longer applied to ring 30, tension spring 27 pulls lever arm 26 counterclockwise until valve 25 is again closed.

Tank 12 is provided at its upper end with screw cap 31 so that liquid can be supplied to tank 12 whenever needed. Desirably, screw cap 31 has a vent hole to facilitate the gravity flow of liquid from tank 12 to header 22 and onto coating roller 18 when valve 25 is opened by pulling ring 30.

While FIG. 4 shows gear wheel 17 used in the apparatus of FIGS. 1, 2 and 3 to ensure positive rotation of roller 18 when the apparatus of this invention is moved over ice with both wheel 17 and roller 18 in contact with the surface of the ice, FIG. 5 shows an alternative wheel 32 having on its tread small conical spikes 33 which can penetrate the surface of the ice to give skid-proof rotation of wheel 32 and the coating roller driven thereby.

The small protrusions on the peripheral surface of the skid-proof wheel, whether in the form of serrations, conical or pyramidal spikes, or the like, need only be about one-sixteenth to about one-eighth inch in height; even such small protrusions dig into the ice sufficiently to ensure rotation of the wheel and the coating roller driven thereby. The skid-proof wheel is usually made of steel although other metals and hard materials may be used.

The coating roller used in the apparatus of this invention may be purchased in most paint stores. It generally has a fibrous cover such as a plush or a sponge-like cover of foamed plastic or rubber on its cylindrical surface, measures about 1¾ inches in diameter and is available in various axial lengths. The length of roller selected for this invention is determined by the width of the colored line that is to be applied on the ice. In most cases, the desired colored line will have a width in the range of 2 to 12 inches.

In contrast to the width or axial length of the coating roller, the skid-proof wheel used to drive the roller need be only about one-eighth inch wide although wider wheels may be used. When the wheel and roller are connected together axially, the diameter of the wheel should be slightly larger than the diameter of the coating roller so that the protrusions on the tread of the wheel will surely sink into the surface of the ice to give positive rotation of both the wheel and its associated roller. In such case, for the popular paint roller of 1¾ inches in diameter, a gear wheel of about 2 inches in diameter will give troublefree rotation to both when the apparatus of this invention is moved over ice.

The colored liquid used to form the desired lines on ice may be prepared by dissolving a dye in water. Also, inks of various colors may be diluted and applied as colored lines on ice.

A cord or flexible wire having one end attached to the apparatus of this invention, say near coating roller mechanism 14, and having a desired length may be attached at its other end to a pivot forced into the ice. In this manner, the apparatus can only move in a circular path and thus form a circular colored line on the ice.

Many variations and modifications of the invention will be apparent to those skilled in the art without departing from the spirit or scope of the invention. For instance, skid-proof wheel 17 shown in FIG. 3 between a side plate 16 and coating roller 18 may be mounted on an extension of shaft 19 so that side plate 16 is then between wheel 17 and axially connected roller 18. Accordingly, only such limitations should be imposed on the invention as are set forth in the appended claims.

What is claimed is:

1. An apparatus for applying a colored liquid line on the surface of ice, which comprises a frame, a coating roller rotatably mounted in said frame, at least one skid-proof wheel rotatably mounted in said frame and having a multiplicity of small protrusions on its peripheral surface capable of digging into said ice when said wheel is rolled thereon, linkage means associated with at least one said wheel and said coating roller to transmit the rotation of the associated wheel to said coating roller while said associated wheel and said coating roller are in rolling contact with said ice, an elongate handle attached to said frame, a liquid tank fastened to said handle, a liquid distributor supported by said frame so that liquid discharging from said distributor will wet said coating roller, and a tube connecting said tank to said distributor.

2. The apparatus of claim 1 wherein the linkage means is an axial connection between an associated wheel and the coating roller, and said associated wheel has a diameter slightly larger than the diameter of said coating roller.

3. The apparatus of claim 2 wherein an associated wheel is a gear wheel.

4. The apparatus of claim 1 wherein an associated wheel has small spikes as the protrusions on its peripheral surface.

5. The apparatus of claim 1 wherein an associated wheel is a gear wheel.

6. The apparatus of claim 1 wherein the tube has an adjustable valve.

7. The apparatus of claim 6 wherein the linkage means is an axial connection between an associated gear wheel and the coating roller, and said associated gear wheel has a diameter slightly larger than the diameter of said coating roller.

* * * * *